US005928832A

United States Patent [19]

Smith et al.

[11] Patent Number: 5,928,832

[45] Date of Patent: Jul. 27, 1999

[54] TONER ADSORPTION PROCESSES

[75] Inventors: Paul F. Smith, Toronto; Beng S. Ong; T. Hwee Ng, both of Mississauga, all of Canada

[73] Assignee: Xerox Corporation, Stamford, Conn.

[21] Appl. No.: 09/219,027

[22] Filed: Dec. 23, 1998

[51] Int. Cl.[6] ..... G03G 9/087

[52] U.S. Cl. ..... 430/137

[58] Field of Search ..... 430/137

[56] References Cited

U.S. PATENT DOCUMENTS

| | | | |
|---|---|---|---|
| 4,137,188 | 1/1979 | Uetake et al. | 252/62.54 |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/137 |
| 5,650,255 | 7/1997 | Ng et al. | 430/137 |
| 5,650,256 | 7/1997 | Veregin et al. | 430/137 |
| 5,766,818 | 6/1998 | Smith et al. | 430/137 |
| 5,863,698 | 1/1999 | Patel et al. | 430/137 |

*Primary Examiner*—Roland Martin
*Attorney, Agent, or Firm*—E. O. Palazzo

[57] ABSTRACT

A process for the preparation of toner comprising mixing a colorant dispersion and a latex emulsion, and wherein there is accomplished a heating below about or equal to about the resin latex glass transition temperature to form aggregates followed by heating above about or equal to about the resin glass transition temperature to coalesce the aggregates; separating the toner formed, and subsequently adding to the toner in the form of a slurry a mixture of monomer and cleavable surfactant, cleaving the surfactant under basic conditions, and allowing the monomer to adsorb on the toner, then polymerizing and cooling, and wherein the cleavable surfactant is of the Formulas (I) or (II), or optionally mixtures thereof (I)

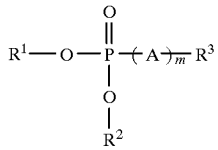

(II)

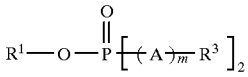

wherein $R^1$ is a hydrophobic aliphatic, or hydrophobic aromatic group; $R^2$ is selected from the group consisting of hydrogen, alkyl, aryl, alkylaryl, and alkylarylalkyl; $R^3$ is hydrogen or alkyl; A is a hydrophilic polymer chain, and m represents the number of A segments

27 Claims, No Drawings

TONER ADSORPTION PROCESSES

PATENT AND PATENT APPLICATION

Illustrated in U.S. Ser. No. 960,754, the disclosure of which is totally incorporated herein by reference, are novel surfactants, that is cleavable or hydrolyzable surfactants of the Formulas (I), (II), or (III), and which surfactants, especially those of Formulas (I), (II), or mixtures thereof may be selected for the processes of the present invention. Also, in U.S. Pat. No. 5,766,818, the disclosure of which is totally incorporated herein by reference, are toner processes wherein cleavable surfactants can be selected.

The appropriate components and processes of the above recited application and patent may be selected for the present invention in embodiments thereof.

BACKGROUND OF THE INVENTION

The present invention is generally directed to toner processes, and more specifically, to aggregation and coalescence or fusion of latex, colorant, like pigment, dye, or mixtures thereof, and optional additive particles, and wherein after the toner is generated there is added thereto a monomer with a surfactant, especially a cleavable surfactant as illustrated in U.S. Pat. No. 5,766,818, subsequently allowing the monomer to absorb on the toner and accomplishing polymerization by heating. In embodiments, the present invention is directed to toner processes which provide toner compositions with, for example, a volume average diameter of from about 1 micron to about 25 microns, and preferably from about 2 microns to about 12 microns, and a narrow particle size distribution of, for example, from about 1.10 to about 1.35, the size and distribution each being measured by the Coulter Counter method without the need to resort to conventional pulverization and classification methods, and wherein a monomer, which is stabilized using a hydrolyzable or cleavable surfactant is selected, and which surfactant hydrolyzes under basic conditions, and wherein more specifically, the surfactant is modified or hydrolyzed into a hydrophobic alkylphenol and a hydrophilic polyethylene glycol under basic conditions wherein the pH is, for example, preferably in the range of from about 7 to about 13 and more preferably in the range of from about 8.5 to about 12, followed by the releasing of the monomer, such as a fluoromonomer, into a slurry of toner particles in water, and which fluoromonomer is present in the water in the amount range of, for example, from about 1 to about 30 percent by weight, and wherein the monomer subsequently adsorbs over a time period in the range of, for example, about 2 to about 180 minutes, and preferably from about 30 to about 125 minutes onto the toner surface, which monomer is then polymerized by, for example, heating the toner slurry containing initiator, toner and fluorinated monomer in the amount of, for example, about 15° C. to 100° C. (Centigrade) and preferably between 20° C. to 80° C. to provide a suitable toner triboelectrical charge and acceptable charge distributions primarily because of the monomer adsorption. There is thus permitted monomer on the toner surface prior to polymerization thereby enabling a substantially even coating of polymer on each toner particle. In important embodiments, the present invention relates to the use of cleavable nonionic surfactants, and which surfactants can be readily hydrolyzed by, for example, the addition of base to the surfactant in the pH range of from about 8 to about 13. In embodiments, the present invention relates to the selection of cleavable surfactants of the formulas illustrated, or mixtures thereof, in emulsion/aggregation/coalescence processes, and wherein in embodiments, such surfactants, contain a phosphate ester linkage in the main chain. The resulting toners can be selected for known electrophotographic imaging and printing processes, including digital color processes.

The toners generated with the processes of the present invention are especially useful for imaging processes, especially xerographic processes, which usually require high, for example about 90 to about 98 percent, toner transfer efficiency, such as those with a compact machine design without a cleaner or those that are designed to provide high quality colored images with excellent image resolution, acceptable signal-to-noise ratio, and image uniformity.

PRIOR ART

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process results it is believed in the formation of particles with a wide particle size distribution. Similarly, the aforementioned disadvantages, for example poor particle size distributions, are obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected; and U.S. Pat. No. 4,558,108, wherein there is disclosed a process for the preparation of a copolymer of styrene and butadiene by specific suspension polymerization. Other prior art that may be of interest includes U.S. Pat. Nos. 3,674,736; 4,137,188 and 5,066,560.

Emulsion/aggregation/coalescence processes for the preparation of toners with optional charge control additives are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256 and 5,501,935, and subsequently related issued patents.

The appropriate components and processes of the above Xerox patents can be selected for the processes of the present invention in embodiments thereof.

SUMMARY OF THE INVENTION

It is a feature of the present invention to provide toner processes with many of the advantages illustrated herein.

In another feature of the present invention there are provided simple and economical processes for the preparation of black and colored toner compositions with excellent colorant dispersions, thus enabling the achievement of excellent color print quality.

In a further feature of the present invention there is provided a process for the preparation of toner compositions with a volume average diameter of from between about 1 to about 25 microns (from about, between about, includes all the values in the range throughout), and preferably from about 2 to about 10 microns, and a particle size distribution of about 1.10 to about 1.28, and preferably from about 1.15 to about 1.25 as measured by a Coulter Counter without the need to resort to conventional classifications to narrow the toner particle size distribution and wherein the toner charge can be increased, especially at high humidities of, for example, 80 percent, and generally wherein the RH sensitivity of the toner is reduced.

In a further feature of the present invention there is provided a process for the preparation of toner by aggregation and coalescence, or fusion (aggregation/coalescence) of latex, colorant, and additive particles, and wherein there is selected a hydrolyzable nonionic surfactant for providing a monomer on the toner surface and which monomer is polymerized.

In yet another feature of the present invention there are provided toner compositions with low fusing temperatures of from about 120° C. to about 180° C., and which toner compositions exhibit excellent blocking characteristics at and above about 45° C.

In still a further feature of the present invention there are provided toner compositions which provide high image projection efficiency, such as for example over 75 percent as measured by the Match Scan II spectrophotometer available from Million-Roy.

Aspects of the present invention relate to a process for the preparation of toner comprising mixing a colorant dispersion and a latex emulsion, and wherein there is accomplished a heating below about or equal to about the resin latex glass transition temperature to form aggregates followed by heating above about or equal to about the resin glass transition temperature to coalesce the aggregates; separating the toner formed, and subsequently adding to the toner in the form of a slurry a mixture of monomer and surfactant, cleaving the surfactant under basic conditions, wherein the monomer adsorbed on the toner, then polymerizing the monomer and optionally cooling, and wherein the surfactant is of the Formulas (I) or (II), or optionally mixtures thereof (I)

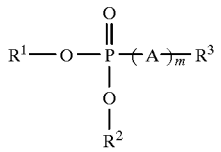

(II)

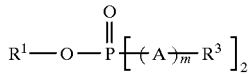

wherein $R^1$ is a hydrophobic aliphatic, or hydrophobic aromatic group; $R^2$ is selected from the group consisting of hydrogen, alkyl, aryl, alkylaryl, and alkylarylalkyl; $R^3$ is hydrogen or alkyl; A is a hydrophilic polymer chain, and m represents the number of A segments; a process wherein the toner slurry is comprised of water and particles in the size range, volume average throughout as determined, for example, by a Coulter Counter, of from about 2 to about 10 microns, and wherein the toner is comprised of resin and colorant; a process wherein the slurry contains from about 5 to about 40 weight percent of toner; a process wherein the monomer is a fluorinated monomer; a process wherein the the monomer is trifluoroethylmethacrylate (TFEMA), trifluoromethyl methacrylate, trifluoropropylmethacrylate, trifluoromethylacrylate, trifluoroethylacrylate, or fluoromethylmethacrylate; a process wherein the monomer is present in the mixture in an amount of about 0.5 to about 10 weight percent, and the surfactant is present in an amount of about 0.01 to about 5 weight percent; a process wherein the polymerizing of monomer is accomplished by heating at a temperature of about 75° C. to about 95° C.; a process wherein there is formed on the toner surface a polymer of poly(fluoromethylacrylate), poly(fluoroethylacrylate), poly (fluoropropylacrylate) poly(methylacrylate), poly (ethylacrylate), poly(propylacrylate), or poly (methylmethacrylate); a process wherein the amount of monomer adsorbed is from about 0.5 to about 10 weight percent; a process wherein the toner triboelectrical charge for the humidity range of about 20 to about 80 percent is from about −10 to about −90 microcoulombs per gram; a process wherein $R^1$ is alkyl, m is a number of from about 2 to about 60, and the A hydrophilic polymer is a poly (oxyalkyleneglycol) selected from the group consisting of a branched polyoxyalkyleneglycol, a block polyoxyalkyleneglycol and a homopolymeric polyoxyalkyleneglycol; a process wherein m is a number of from about 5 to about 60, or from about 10 to about 50, and the weight average molecular weight of A is from about 100 to about 3,000; a process wherein $R^1$ is methylphenyl, ethylphenyl, propylphenyl, butylphenyl, pentylphenyl, hexylphenyl, octylphenyl, or nonylphenyl; $R^2$ is hydrogen, methyl, ethyl, methylphenyl, or propyl; $R^3$ is methyl, ethyl, propyl, or butyl; and A is polyoxyalkyleneglycol, polyethyleneglycol, or polypropyleneglycol; a process wherein $R^1$ is an alkylaryl group, or an alkylaryl group with a substituent of fluorine, chlorine, or bromine, wherein alkyl contains from about 2 to about 30 carbon atoms; $R^2$ alkyl contains from 1 to about 30 carbon atoms; $R^3$ alkyl contains from 1 to about 3 carbon atoms; and wherein A is a hydrophilic poly (oxyalkyleneglycol) selected from the group consisting of a branched, block or homopolymeric polyoxyalkyleneglycol derived from alkylene oxides with from about 2 to about 4 carbon atoms; a process wherein the latex resin is generated from the polymerization of monomers to provide a latex emulsion with submicron resin particles in the size range of from about 0.05 to about 0.3 micron in volume average diameter, and wherein the latex contains an ionic surfactant, a water soluble initiator and a chain transfer agent; adding anionic surfactant to retain the size of the toner aggregates formed; thereafter coalescing or fusing the aggregates by heating; and optionally isolating, washing, and drying the toner; a process wherein the surfactant is mixed with the toner slurry at a pH in the range of from about 8 to about 13; a process wherein the basic condition is achieved by a medium, or solution in the pH range of from about 8.5 to about 12; a process wherein the surfactant is selected in an amount of from about 1 to about 3 weight percent; a process wherein there is selected a surfactant for the colorant dispersion, and which surfactant is a cationic surfactant, and an ionic surfactant is present in the latex mixture and which surfactant is an anionic surfactant; wherein the aggregation is accomplished at a temperature of about 15° C. to about 1°

C. below the Tg of the latex resin for a duration of from about 0.5 hour to about 3 hours; and wherein the coalescence or fusion of the components of aggregates for the formation of integral toner particles comprised of colorant, and resin additives is accomplished at a temperature of from about 85° C. to about 95° C. for a duration of from about 1 hour to about 5 hours; a process wherein the latex resin, or polymer is selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid); a process wherein the latex contains a resin selected from the group consisting of poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly (styrene-butyl acrylate), poly(styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); and wherein the colorant is a pigment; a process wherein the anionic surfactant is selected from the group consisting of sodium dodecyl sulfate, sodium dodecylbenzene sulfate and sodium dodecyinaphthalene sulfate; a process wherein the colorant is carbon black, cyan, yellow, magenta, or mixtures thereof; a process wherein the toner particles isolated are from about 2 to about 10 microns in volume average diameter, and the particle size distribution thereof is from about 1.15 to about 1.30, and wherein the ionic surfactant utilized represents from about 0.01 to about 5 weight percent of the total reaction mixture; a process wherein there is added to the surface of the formed toner metal salts, metal salts of fatty acids, silicas, metal oxides, or mixtures thereof, each in an amount of from about 0.1 to about 10 weight percent of the obtained toner particles; a process which comprises mixing a resin latex, an ionic surfactant and colorant, and a surfactant of the Formulas (I), or (II); heating the resulting mixture below about, or equal to about the glass transition temperature of the resin; thereafter heating the resulting aggregates above about, or about equal to the glass transition temperature of the resin; and cooling, isolating, washing and drying the toner (I)

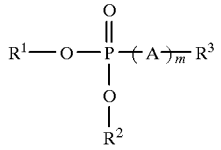

(II)

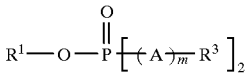

wherein $R^1$ is a hydrophobic group; $R^2$ is selected from the group consisting of hydrogen, alkyl, aryl, alkylaryl, and alkylarylalkyl; $R^3$ is hydrogen or alkyl; A is a hydrophilic segment; and m represents the number of A segments, and subsequently adding to the toner in the form of a slurry a mixture of monomer and cleavable surfactant allowing the monomer to adsorb on the toner, then polymerizing and cooling; a process wherein the surfactant is selected from the group consisting of poly(ethyleneglycol) methyl p-tert-octylphenyl phosphate, poly(ethyleneglycol)-α-methyl ether-ω-methyl p-tert-octylphenyl phosphate, poly (ethyleneglycol) methyl decylphenyl phosphate, poly (ethyleneglycol)-α-methyl ether-ω-methyl dodecylphenyl phosphate, poly(ethyleneglycol) methyl dodecylphenyl phosphate, bis[poly(ethyleneglycol)-α-methyl ether]-ω-p-tert-octylphenyl phosphate, poly(ethyleneglycol)-α,ω-methyl p-tert-octylphenyl phosphate, poly(ethyleneglycol) ethyl p-tert-octylphenyl phosphate, poly(ethyleneglycol)-α-methyl ether-ω-ethyl p-tert-octylphenyl phosphate, poly (ethyleneglycol) phenyl p-tert-octylphenyl phosphate, poly (ethyleneglycol)-α-methyl ether-ω-phenyl p-tert-octylphenyl phosphate, poly(ethyleneglycol) tolyl p-tert-octylphenyl phosphate, poly(ethyleneglycol)-α-methyl ether-ω-tolyl p-tert-octylphenyl phosphate, and poly (ethylene oxide-co-propylene oxide) methyl p-tert-octylphenyl phosphate, wherein the polymer chain contains from about 5 to about 50 repeating units or segments; processes for the preparation of toner compositions by aggregation/coalescence of latex and colorant, especially pigment particles, and wherein the temperature of aggregation can be selected to control the aggregate size, and thus the final toner particle size, and the coalescence temperature and time can be utilized to control the toner shape and surface properties, and wherein there is selected a cleavable nonionic surfactant as illustrated herein. The process for the preparation of toner in embodiments involves mixing a colorant dispersion containing a surfactant of opposite polarity than the latex ionic surfactant and a latex emulsion, and wherein the latex emulsion contains resin and an ionic surfactant and heating below about or equal to about the resin latex glass transition temperature to form aggregates followed by heating above about or equal to about the resin to coalesce the aggregates; thereafter cooling, isolating the toner, washing and drying the toner. Subsequently, there is added to the toner the mixture of monomer and cleavable surfactant encompassed by the formulas indicated herein under a basic pH, hydrolyzing the cleavable surfactant under these conditions, followed by allowing the monomer to adsorb onto the toner, then polymerizing and cooling. The latex resin can be generated from the polymerization of monomers to provide a latex emulsion with submicron resin particles in the size range of from about 0.05 to about 0.3 micron in volume average diameter, and wherein the latex contains an ionic surfactant, a water soluble initiator and a chain transfer agent, and the process involves adding anionic surfactant to retain the size of the toner aggregates formed, thereafter coalescing or fusing the aggregates by heating, and isolating, washing, and drying the toner. In embodiments, the present invention relates to an emulsion process wherein isolating, washing and drying is accomplished; a process wherein the temperature at which the aggregation is accomplished may be selected to control the size of the aggregates, and wherein the final toner size is from about 2 to about 15 microns in volume average diameter, and wherein the aggregation temperature is from about 45° C. to about 55° C., and wherein the coalescence or fusion temperature is from about 85° C. to about 95° C.; and a process wherein the surfactant utilized in preparing the colorant dispersion is a cationic surfactant, and the ionic surfactant present in the latex mixture is an anionic surfactant; wherein the aggregation is accomplished at a temperature about 15° C. to about 1° C. below the Tg of the latex resin for a duration of from about 0.5 hour to about 3 hours; and wherein the coalescence or fusion of the components of aggregates for the formation of integral toner particles comprised of colorant, and resin additives is accomplished at a temperature of from about 85° C. to about 95° C. for a duration of from about 1 hour to about 5 hours; a process wherein the latex resin, or polymer is selected from the group consisting of poly(styrene-alkyl acrylate), poly (styrene-1,3-diene), poly(styrene-alkyl methacrylate), poly (styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly (styrene-alkyl acrylate-acrylonitrile-acrylic acid), poly (styrene-1,3-diene-acrylonitrile-acrylic acid), and poly(alkyl acrylate-acrylonitrile-acrylic acid), wherein the resin is present in an effective amount of from about 80 percent by weight to about 98 percent by weight of toner, and wherein the colorant is a pigment; a process wherein the latex resin is selected from the group consisting of poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid), and wherein the colorant is a pigment; a process wherein the anionic surfactant is selected from the group consisting of sodium dodecyl sulfate, sodium dodecylbenzene sulfate and sodium dodecylnaphthalene sulfate; a process wherein the colorant is carbon black, cyan, yellow, magenta, or mixtures thereof; a process wherein the toner particles isolated are from about 2 to about 10 microns in volume average diameter as measured with a Coulter Counter, and the particle size distribution thereof is from about 1.15 to about 1.30, wherein the ionic surfactant utilized represents from about 0.01 to about 5 weight percent of the total reaction mixture; a process wherein there is added to the surface of the formed toner metal salts, metal salts of fatty acids, silicas, metal oxides; and a process comprising the preparation, or provision of a latex emulsion comprised of resin particles in the size range of from about 0.5 to about 3 microns containing an ionic surfactant, a water soluble initiator and a chain transfer agent; aggregating a colorant dispersion with the latex emulsion and optional additives to form toner sized aggregates; freezing or maintaining the size of aggregates with an anionic surfactant; coalescing or fusing the aggregates by heating; and isolating, washing, and drying the toner followed by the addition of the monomer hydrolyzable/cleavable surfactant mixture, hydrolyzing the hydrolyzable surfactant under basic pH, allowing the monomer to adsorb onto the toner surface, and polymerizing the adsorbed monomer; a process comprised of blending an aqueous colorant, especially pigment dispersion containing an ionic surfactant with a latex emulsion containing resin, water, and an ionic surfactant of opposite charge polarity to that of the ionic surfactant in the colorant dispersion, thereafter heating the resulting flocculent mixture at, for example, from about 35° C. to about 60° C. (Centigrade) to form toner sized aggregates of from about 2 microns to about 20 microns in volume average diameter, and which toner is comprised of polymer, colorant, such as pigment and optionally additive particles, followed by heating the aggregate suspension at, for example, from about 70° C. to about 100° C. to effect coalescence or fusion of the components of the aggregates and to form mechanically stable integral toner particles. Subsequently, there is added to the toner generated, contained in the form of a slurry of a mixture containing, for example, from about 85 weight percent to about 98 weight percent resin and preferably from about 2 to about 15 weight percent pigment, and cleavable surfactant encompassed by the formulas indicated herein, followed by enabling the monomer to adsorb on the toner to a quantity in the range of about 0.05 to about 10 weight percent, then polymerizing and cooling to about room temperature about 25° C.; and toner processes wherein there is selected a cleavable nonionic surfactant of U.S. Ser. No. 960,754, and more specifically, as represented by the following Formulas (I) or (II), or mixtures thereof (I)

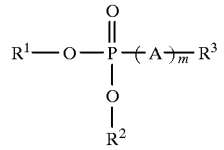

(II)

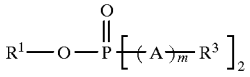

wherein $R^1$ is a hydrophobic aliphatic/aromatic group of, for example, alkyl, aryl, an alkylaryl, or an alkylaryl group with, for example, a suitable substituent, such as halogen like fluorine, chlorine, or bromine, wherein alkyl contains, for example, from about 4 to about 60 carbon atoms, and aryl contains from, for example, about 6 to about 60 carbon atoms; $R^2$ can be selected from the group consisting of hydrogen, alkyl, aryl, alkylaryl, and alkylarylalkyl wherein each alkyl may contain, for example, from 1 to about 6 carbon atoms; $R^3$ is hydrogen or alkyl of, for example, 1 to about 10 carbon atoms; A is a hydrophilic polymer chain of polyoxyalkylene, polyvinyl alcohols, poly(saccharides), and more specifically, poly(oxyalkylene glycols) being selected, for example, from the group consisting of at least one of the heteric, block or homopolymer polyoxyalkylene glycols derived from the same or different alkylene oxides; wherein m is an integer, or a number of from, for example, about 2 to about 500, or about 5 to about 100, and wherein in embodiments the weight average molecular weight, $M_w$, of A is, for example, from about 100 to about 300, or from about 104 to about 2,500, and which A is available from Aldrich Chemicals.

In the surfactant, formulas $R^1$ can be methylphenyl, ethylphenyl, propylphenyl, butylphenyl, pentylphenyl, hexylphenyl, octylphenyl, or nonylphenyl; $R^2$ can be hydrogen, methyl, ethyl, methylphenyl, or propyl, $R^3$ is hydrogen, methyl, ethyl, propyl, or butyl; A can be polyoxyalkyleneglycol, polyethyleneglycol, or polypropyleneglycol, and wherein $R^1$ is preferably an alkylphenyl such as octylphenyl, $R^2$ is a methyl, $R^3$ is methyl and A is polyethyleneglycol. The substituents and specific examples thereof are illustrated in copending application U.S. Ser. No. 960,754. More specifically, the cleavable nonionic surfactants selected can be of the Formulas (I), (II), or (III), or mixtures thereof, and preferably of Formulas (I) or (II)

(I)

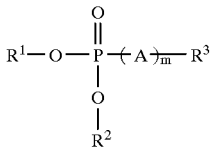

(II)

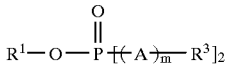

(III)

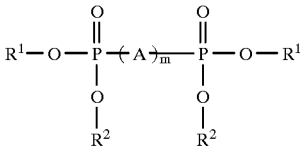

wherein $R^1$ is a hydrophobic moiety selected from, for example, the group consisting of alkyl, aryl, and their substituted derivatives, such as those containing a halogen atom, such as fluorine, chlorine or bromine, and wherein the alkyl group contains, for example, from about 4 to about 60, and preferably from about 6 to about 30 carbon atoms, and the aryl group contains, for example, from about 6 to about 60, and preferably from about 10 to about 30 carbon atoms; $R^2$ may be the same as $R^1$ or different, and can be selected from the group consisting of alkyl, aryl, and their substituted derivatives; $R^3$ is hydrogen or alkyl of from, for example, about 1 to about 10, and preferably 1 to about 3 carbon atoms; A is a hydrophilic polymer chain selected, for example, from the group consisting of polyoxyalkylene, poly(vinyl alcohols), poly(saccharides) and the like, and preferably is a polyoxyalkylene derived from the same or different alkylene oxides with from about 2 to about 4 carbon atoms; and m is the number of repeating units of the hydrophilic polymer chain, and can be a number of, for example, from about 2 to about 500, and preferably from about 5 to about 100.

Specific examples of cleavable surfactants that may be selected are poly(ethyleneglycol) methyl p-tert-octylphenyl phosphate, poly(ethyleneglycol)-α-methyl ether-ω-methyl p-tert-octylphenyl phosphate, poly(ethyleneglycol) methyl decylphenyl phosphate, poly(ethyleneglycol)-α-methyl ether-ω-methyl dodecylphenyl phosphate, poly (ethyleneglycol) methyl dodecylphenyl phosphate, bis[poly (ethyleneglycol)-α-methyl ether]-ω-p-tert-octylphenyl phosphate, poly(ethyleneglycol)-α,ω-methyl p-tert-octylphenyl phosphate, poly(ethyleneglycol) ethyl p-tert-octylphenyl phosphate, poly(ethyleneglycol)-α-methyl ether-ω-ethyl p-tert-octylphenyl phosphate, poly (ethyleneglycol) phenyl p-tert-octylphenyl phosphate, poly (ethyleneglycol)-α-methyl ether-ω-phenyl p-tert-octylphenyl phosphate, poly(ethyleneglycol) tolyl p-tert-octylphenyl phosphate, poly(ethyleneglycol)-α-methyl ether-ω-tolyl p-tert-octylphenyl phosphate, and poly (ethylene oxide-co-propylene oxide) methyl p-tert-octylphenyl phosphate, and preferably wherein the polymer chain contains from about 5 to about 50 repeating units or segments.

The surfactant of the above formulas is primarily selected to provide a suitable monomer, such as a hydrophobic monomer to the toner surface, and more specifically wherein this is accomplished by dispersing a mixture of the monomer, such as trifluoroethylmethacrylate, (TFEMA), trifluoromethylmethacrylate and the cleavable surfactant in water. The resulting solution is then added to a slurry of toner particles, generated by an aggregation and coalescence of a latex emulsion as described in U.S. Pat. No. 5,766,818, the disclosure of which is totally incorporated herein by reference, and wherein the toner particles are comprised of resin in various suitable amounts, for example from about 85 to about 97 weight percent, and colorant in various suitable amounts, for example, from about 3 to about 15 weight percent, and wherein the total of resin and colorant is about 100 percent. The monomer solution is added in the range amount of, for example, about 1 to about 30 weight percent of the toner and which solution is in the form of a water slurry at a pH of, for example, about 8 to about 11, measured using an Orion Model 230A pH meter, and wherein the surfactant enables the monomer to be initially dispersed evenly onto the toner and wherein the monomer is adsorbed on the toner. It is believed that the basic conditions hydrolyzes the surfactant thereby preventing, or minimizing the emulsion polymerization within the surfactant stabilized monomer droplets. Primarily because of the hydrolysis of the surfactant, the stabilized monomer droplets are destabilized, and the monomer is released into the toner slurry, where due to the hydrophobicity of the monomer, it adsorbs onto the toner surface.

Initiators, such as azo-type initiators like, for example, azobis-2-2'-azobis(dimethylvaleronitrile), azobis (isobutyronitrile), mixtures thereof and the like, peroxide initiators such as benzoyl peroxide, lauryl peroxide, methyl ethyl ketone peroxide, potassium persulfate, ammonium persulfate and sodium bisulfite in the amount range of, for example, about 0.0001 weight to about 0.002 weight percent are then added and the toner slurry is heated in the temperature range of from about 15° C. to about 90° C. to initiate polymerization of the monomer.

More specifically, a surface coated modified toner can be prepared by (I) roll milling about 0.5 to about 10, and preferably about 1 to about 7 weight percent of a monomer, such as a fluorinated monomer in about 0.01 to about 5 weight percent of the hydrolyzable surfactant in water for a suitable time, for example, about 5 to about 30 minutes; (II)

washing the toner comprised of a colorant and a resin of, for example, about 78 weight percent of styrene, about 20 weight percent of butyl acrylate and about 2 weight percent of acrylic acid, four times at pH of about 8.5 using a solution of, for example, potassium hydroxide, sodium hydroxide or ammonium hydroxide; (III) adding about, for example, 20 to about 200 grams of the stabilized monomer solution prepared in (I) using a micropump at about 0.05 to 10 milliliters/minute to a slurry of about 10 grams to about 200 grams of the washed toner prepared in (II) in about 200 to about 1,000 milliliters of distilled water at a pH of about 8 to about 13 by the addition of a basic solution of about 0.5 weight percent to about 10 weight percent of an alkali metal hydroxide, such as potassium hydroxide; (IV) during the addition of the monomer emulsion, stirring the slurry at about 100 to about 500 rpm; (V) subsequently and after the monomer addition, the stirring speed is reduced to from about 50 to about 300 rpm and the monomer is allowed to adsorb for a suitable time of, for example, about 5 to about 200 minutes; (VI) adding about 1 milligram to about 50 milligrams of an initiator, such as azobis(isobutyronitrile) or ammonium persulfate, dissolved in about 5 to 500 milliliters of distilled water to the resulting toner slurry and heating the resulting slurry to a temperature in the range of 15 to 90° C. for a suitable time of, for example, about 30 minutes to about 600 minutes; and (VII) filtering and drying the toner using a freeze dryer; processes for the preparation of toner compositions which comprises blending an aqueous colorant dispersion preferably containing a pigment, such as carbon black, phthalocyanine, quinacridone or RHODAMINE B™ type, red, green, orange, brown, and the like, with a cationic surfactant, such as benzalkonium chloride, with a latex emulsion derived from the emulsion polymerization of monomers selected, for example, from the group consisting of styrene, butadiene, acrylates, methacrylates, acrylonitrile, acrylic acid, methacrylic acid, and the like, and which latex contains an ionic surfactant, such as sodium dodecylbenzene sulfonate, and which latex resin is of a size of, for example, from about 0.05 to about 0.5 micron in volume average diameter; heating the resulting flocculent mixture at a temperature ranging from about 35° C. to about 60° C. for an effective length of time of, for example, 0.5 hour to about 2 hours to form toner sized aggregates; and subsequently heating the aggregate suspension at a temperature at or below about 95° C. to provide toner particles; and finally isolating the toner product by, for example, filtration, washing and drying in an oven, fluid bed dryer, freeze dryer, or spray dryer, whereby toner particles comprised of polymer, or resin, colorant, and optional additives are obtained. Subsequently, there is added to the toner the mixture of monomer and cleavable surfactant encompassed by the formulas indicated herein, followed by allowing the monomer to adsorb on the toner, then polymerizing and cooling; processes for the preparation of toner comprised of polymer and colorant, especially pigment comprising (0) the preparation, or provision of a latex emulsion comprising submicron resin particles, such as styrene, butylacrylate, acrylic acid, which are in the size diameter range of from about 0.05 to about 0.3 microns in volume average diameter, an ionic surfactant, a water soluble initiator and a chain transfer agent, (i) blending an aqueous colorant like a pigment dispersion containing an ionic surfactant with the latex emulsion;

(ii) heating the resulting mixture at a temperature about 25° C. to about 1° C. below the Tg (glass transition temperature) of the latex polymer to form toner sized aggregates;

(iii) subsequently stabilizing the aggregates with anionic surfactant and heating the stabilized aggregate suspension to a temperature of about 85° C. to about 95° C. to effect coalescence or fusion of the components of aggregates to enable formation of integral toner particles comprised of polymer, colorant, especially pigment and optional additives; and (iv) isolating the toner product by, for example, filtration, followed by washing and drying. Subsequently, there is added to the toner the mixture of monomer and cleavable surfactant encompassed by the formulas indicated herein, hydrolyzing the surfactant under basic conditions, followed by allowing the monomer to adsorb on the toner, then polymerizing and cooling; and a process for the preparation of toner compositions, which comprise (i) preparing an ionic pigment mixture by dispersing a colorant, especially pigment, such as carbon black, HOSTAPERM PINK™, or PV FAST BLUE™, in an aqueous surfactant solution containing a cationic surfactant, such as dialkylbenzene dialkylammonium chloride like SANIZOL B-50™ available from Kao or MIRAPOL™ available from Alkaril Chemicals, by means of a high shearing device such as a Brinkmann Polytron or IKA homogenizer; (ii) adding the aforementioned colorant, especially pigment mixture, to a latex emulsion of polymer particles of, for example, poly(styrene-butyl acrylate-acrylic acid), poly(styrene-butadiene-acrylic acid), and the like, an anionic surfactant, such as sodium dodecylsulfate, dodecylbenzene sulfonate or NEOGEN R™, thereby causing a flocculation of pigment, polymer particles and optional additives; (iii) homogenizing the resulting flocculent mixture with a high shearing device, such as a Brinkmann Polytron or IKA homogenizer, and further stirring with a mechanical stirrer at a temperature of about 1° C. to about 25° C. below the Tg of the latex polymer to form toner sized aggregates of from about 2 microns to about 12 microns in volume average diameter;

(v) heating the mixture in the presence of additional anionic surfactant at a temperature of 95° C. or below for a duration of, for example, from about 1 to about 5 hours to form 2 to 10 micron toner particles with a particle size distribution of from about 1.15 to about 1.35 as measured by the Coulter Counter; and (vi) isolating the toner particles by filtration, washing, and drying. Additives to improve flow characteristics and charge additives, if not initially present, to improve charging characteristics may then be added by blending with the formed toner, such additives including AEROSILS® or silicas, metal oxides like tin, titanium and the like, metal salts of fatty acids like zinc stearate, mixtures thereof, and the like, and which additives are present in various effective amounts, such as from about 0.1 to about 10 percent by weight of the toner for each additive. Subsequently, there is added to the toner the mixture of monomer and cleavable surfactant encompassed by the formulas indicated herein, hydrolyzing the surfactant under basic conditions, followed by allowing the monomer to adsorb on the toner, then polymerizing and cooling.

Examples of initiators used in the range amount of, for example, about 1 to about 50 milligrams and preferably from about 5 to about 40 milligrams are, for example, disclosed in U.S. Pat. No. 5,213,938, the disclosure of which is totally incorporated herein by reference, and which initiators function to initiate polymerization of the adsorbed fluorinated monomer, are azo-type initiators such as 2-2'-azobis (dimethylvaleronitrile), azobis(isobutyronitrile), azobis (cyclohexane-nitrile), azobis(methyl-butyronitrile), mixtures thereof and the like, peroxide initiators such as benzoyl peroxide, lauryl peroxide, methyl ethyl ketone peroxide, isopropyl peroxy carbonate, 2,5-dimethyl-2,5-bis(2-ethylhexanoyl-peroxy)hexane, di-tert-butyl peroxide, cumene hydroperoxide, dichlorobenzoyl peroxide, and the like, and potassium persulfate, ammonium persulfate and sodium bisulfite and mixtures thereof.

Monomer examples are, for example, disclosed in U.S. Pat. No. 5,213,938, the disclosure of which is totally incorporated herein by reference, and include fluoromonomers such as fluoroacrylates, fluoromethacrylates or fluorostyrenes such as trifluoroethylmethacrylate, (TFEMA), trifluoromethylmethacrylate, trifluoropropylmethacrylate, trifluoromethylacrylate, trifluoroethylacrylate, fluoromethylmethacrylate, fluoroethylmethacrylate, fluoropropylmethacrylate, fluoromethylacrylate, fluoroethylacrylate, difluoromethylmethacrylate, difluoroethylmethacrylate, difluoropropylmethacrylate, difluoromethylacrylate, difluoroethylacrylate, fluorostyrene, difluorostyrene, trifluorostyrene, tetrafluorostyrene, pentafluorostyrene mixtures thereof and the like. The polymers formed from these monomers, and which polymers are present on the toner surface in for example suitable amounts, such as from about 0.5 to about 10 weight percent based on the toner weight, are poly(fluoromethylacrylate), poly (fluoroethylacrylate), poly(fluoropropylacrylate), poly (difluoroethyl acrylate), poly(difluoropropylacrylate), poly (trifluoroethylacrylate), poly(trifluoropropylacylate), poly (fluoromethylmethacrylate), poly(fluoroethyl methacrylate), poly(fluoropropylmethacrylate), poly(difluoromethyl methacrylate), poly(difluoroethylm ethacrylate), poly (difluoropropyl methacrylate), poly (trifluoromethylmethacrylate), poly(trifluoroethyl methacrylate), poly(trifluoropropylmethacrylate), poly (trifluoroethyl methacrylate)-co-polymethylmethacrylate, poly(trifluoropropylmethacrylate)-co-poly (methylmethacrylate), poly(trfluoroethylmethacrylate)-co-poly(ethylmethacrylate), poly(trifluoroethylmethacrylate)-co-polystyrene, poly(trifluoropropylacrylate)-copoly (methylmethacrylate), and mixtures thereof. Monomer other than flourinated monomers can be selected from, for example, acrylates, methacrylates or styrenes such as ethylmethacrylate, methylmethacrylate, propylmethacrylate, methylacrylate, ethylacrylate, styrene, mixtures thereof and the like. The polymers formed from these monomers are from the group comprising of poly (methylacrylate), poly(ethylacrylate), poly(propylacrylate), poly(methylmethacrylate), poly(ethylmethacrylate), poly (propylmethacrylate), poly(propylmethacrylate)-co-poly (methylmethacrylate), poly(ethylmethacrylate)-co-poly (methyl methacrylate), poly(ethylmethacrylate)-co-polystyrene, poly(propylacrylate)-copoly (methylmethacrylate), and mixtures thereof.

One important advantage of the processes of the present invention is that the hydrolyzable surfactants can be easily removed from the monomer surface, thus destabilizing the monomer droplets and allowing their adsorption onto the toner surface. Use of an adsorption polymerized monomer on the surface of the toner results in the toner possessing a controlled hydrophobic surface, preventing, or minimizing water adsorption and hence, for example, increasing the toner tribo charge.

The particle size of toner compositions provided by the processes of the present invention in embodiments can be controlled by the temperature at which the aggregation of latex, colorant, such as pigment, and optional additives is conducted. In general, the lower the aggregation temperature, the smaller the aggregate size, and thus the final toner size. For a latex polymer with a glass transition temperature (Tg) of about 55° C. and a reaction mixture with a solids content of about 12 percent by weight, an aggregate size of about 7 microns in volume average diameter is obtained at an aggregation temperature of about 53° C.; the same latex will provide an aggregate size of about 5 microns at a temperature of about 48° C. under similar conditions. Moreover, as illustrated in a related application U.S. Ser. No. 922,437, the disclosure of which is totally incorporated herein by reference, the presence of certain metal ion or metal complexes such as aluminum complex in embodiments enables the coalescence of aggregates to proceed at lower temperature of, for example, less than about 95° C. and with a shorter coalescence time of less than about 5 hours.

In embodiments of the present invention, an aggregate size stabilizer can be added during the coalescence to prevent the aggregates from growing in size, or minimize aggregate growth, with increasing temperature, and which stabilizer is generally an ionic surfactant with a charge polarity opposite to that of the ionic surfactant in the colorant, especially pigment dispersion.

Illustrative examples of specific latex resin, polymer or polymers selected include known polymers such as poly (styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butylacrylate), poly (styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly (butyl methacrylate-acrylic acid), poly(styrene-butyl acrylate-acrylonitrile-acrylic acid), poly(acrylonitrile-butyl acrylate-acrylic acid), and the like. The latex polymer, or resin is generally present in the toner compositions of the present invention in various suitable amounts, such as from about 75 weight percent to about 98, or from about 80 to about 95 weight percent of the toner, and the latex size suitable for the processes of the present invention can be, for example, from about 0.05 micron to about 1 micron in volume average diameter as measured by the Brookhaven nanosize particle analyzer. Other sizes and effective amounts of latex polymer may be selected in embodiments. The total of all toner components, such as resin and colorant, is about 100 percent, or about 100 parts.

The polymer selected for the process of the present invention is preferably prepared by emulsion polymerization methods, and the monomers utilized in such processes include, for example, styrene, acrylates, methacrylates, butadiene, isoprene, acrylic acid, methacrylic acid, acrylonitrile, and the like. Known chain transfer agents, for example dodecanethiol, from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference; polymer solution microsuspension process, such as disclosed in U.S. Pat. No. 5,290,654, the disclosure of which is totally incorporated herein by reference, mechanical grinding processes, or other known processes. Also, the reactant initiators, chain transfer agents, and the like as disclosed in U.S. Ser. No. 922,437, the disclosure of which is totally incorporated herein by reference, can be selected for the processes of the present invention.

Various known colorants, such as pigments, selected for the processes of the present invention and present in the toner in an effective amount of, for example, from about 1 to about 20 percent by weight of toner, and preferably in an amount of from about 3 to about 10 percent by weight, that can be selected include, for example, carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E. D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA Magenta™ available from E.I. DuPont de Nemours & Company, and the like. generally, colored pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. Known dyes may be selected, such as food dyes, and the like.

Colorants, include pigment, dye, mixtures of pigment and dyes, mixtures of pigments, mixtures of dyes, and the like.

Examples of initiators selected for the processes of the present invention include water soluble initiators such as ammonium and potassium persulfates in suitable amounts, such as from about 0.1 to about 8 percent and preferably in the range of from about 0.2 to about 5 percent (weight percent). Examples of organic soluble initiators include Vazo peroxides, such as Vazo 64, 2-methyl 2-2'-azobis propanenitrile, Vazo 88, 2-2'-azobis isobutyramide dehydrate in a suitable amount, such as in the range of from about 0.1 to about 8 percent. Examples of chain transfer agents include dodecanethiol, octanethiol, carbon tetrabromide and the like in various suitable amounts, such as in the range amount of from about 0.1 to about 10 percent and preferably in the range of from about 0.2 to about 5 percent by weight of monomer.

Surfactants for the latex preparation selected in effective amounts of, for example, from about 0.01 to about 15, or from about 0.01 to about 5 weight percent of the reaction mixture in embodiments include, for example, anionic surfactants, such as for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, cationic surfactants, such as for example dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, in effective amounts of, for example, from about 0.01 percent to about 10 percent by weight. Preferably, the molar ratio of the cationic surfactant used for flocculation to the anionic surfactant used in the latex preparation is in the range of from about 0.5 to 4.

Examples of surfactants, which can be added to the aggregates prior to coalescence is initiated can be selected from anionic surfactants, such as for example sodium dodecylbenzene sulfonate, sodium dodecyinaphthalene sulfate, dialkyl benzenealkyl, sulfates and sulfonates, abitic acid, available from Aldrich, NEOGEN R™, NEOGEN SC™ obtained from Kao, and the like; nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™, and hydrolyzable or cleavable nonionic surfactants of the formulas illustrated herein, such as poly(ethyleneglycol) methyl p-tert-octylphenyl phosphate, wherein the surfactant contains, for example, 40 ethyleneglycol units, poly (ethyleneglycol)-α-methyl ether-ω-methyl p-tert-octylphenyl phosphate (wherein the surfactant contains 17 ethyleneglycol units). An effective amount of the anionic or nonionic surfactant utilized in the coalescence to stabilize the aggregate size against further growth with temperature is, for example, from about 0.01 to about 10 percent by weight, and preferably from about 0.5 to about 5 percent by weight of reaction mixture.

The toner may also include known charge additives in effective suitable amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, negative charge enhancing additives like aluminum complexes, other known charge additives, and the like.

Surface additives that can be added to the toner compositions after washing or drying include, for example, metal salts, metal salts of fatty acids, colloidal silicas, metal oxides, strontium titanates, mixtures thereof, and the like, which additives are each usually present in an amount of from about 0.1 to about 2 weight percent, reference for example U.S. Pat. Nos. 3,590,000; 3,720,617; 3,655,374 and 3,983,045, the disclosures of which are totally incorporated herein by reference. Preferred additives include zinc stearate and the silicas available from Cabot Corporation and Degussa Chemicals, such as coated silicas and AEROSIL R972® available from Degussa, the coated silicas of U.S. Ser. No. 09/132,188, U.S. Ser. No. 09/132,185 and U.S. Ser. No. 09/132,623, the disclosures of each patent application being totally incorporated herein by reference, each in amounts of, for example, from about 0.1 to about 2 percent, which additives can be added during the aggregation or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carrier particles can also be comprised of a core with a polymer coating thereover, such as polymethylmethacrylate (PMMA) having dispersed therein a conductive component like conductive carbon black. Carrier coatings include silicone resins, fluoropolymers, mixtures of resins not in close proximity in the triboelectric series, thermosetting resins, and other known components.

Imaging methods are also envisioned with the toners of the present invention, reference for example a number of the patents mentioned herein, and U.S. Pat. Nos. 4,265,660; 4,858,884; 4,584,253 and 4,563,408, the disclosures of which are totally incorporated herein by reference.

The following Examples are being submitted to further define various pieces of the present invention. These Examples are intended to be illustrative only and are not intended to limit the scope of the present invention. Comparative Examples and data are also provided. The surfactants of Formulas (I) or (II) were prepared as illustrated in U.S. Ser. No. 960,754, the disclosure of which is totally incorporated herein by reference.

EXAMPLE I

LATEX PREPARATION

A latex emulsion comprised of polymer particles generated from the emulsion polymerization of styrene, butyl acrylate and acrylic acid was prepared as follows. A mixture of 2,255 grams of styrene, 495 grams of butyl acrylate, 55.0 grams of acrylic acid, 27.5 grams of carbon tetrabromide and 96.25 grams of dodecanethiol was added to an aqueous solution prepared from 27.5 grams of ammonium persulfate in 1,000 milliliters of water and 2,500 milliliters of an aqueous solution containing 62 grams of anionic surfactant, NEOGEN R™ for example sodium dodecylbenzene sulfonate, and 33 grams of ANTAROX™ CA897, for example ethoxylated nonylphenol wherein the ethylene repeating units are in the range $C_{27}$–$C_{40}$. The resulting mixture was homogenized at room temperature of about 25° C. under a nitrogen atmosphere for 30 minutes. Subsequently, the mixture was stirred and heated to 70° C. (Centigrade throughout) at a rate of 1° C. per minute, and retained at this temperature for 6 hours. The resulting latex polymer possessed an $M_w$ of 30,500, an $M_n$ of 5,400, both as measured by gel permeation chromatography, and a mid-point Tg of 53° C. as measured by differential scanning calorimetry.

AGGREGATION OF CYAN TONER 260.0 Grams of the latex emulsion as prepared above and 220 grams of an aqueous cyan pigment dispersion containing 8.0 grams of cyan pigment 15.3, and which colorant dispersion had a solids loading of 53.4 percent, and 2.4 grams of cationic surfactant SANIZOL B™ were simultaneously added to 400 milliliters of water with shear stirring by means of a polytron at 6,000 rpm. The resulting mixture was transferred to a 2 liter reaction vessel and heated at a temperature of 50° C. for 2 hours resulting in aggregates of a size of 5.9 microns and a GSD of 1.20 before 30 milliliters of 20 percent aqueous NEOGEN R™ solution was added. Subsequently, the mixture resulting was heated to 95° C. and held there for a period of 4 hours before cooling down to room temperature, about 25° C. throughout, filtered, washed with water at pH 10 using KOH, and dried in a freeze dryer. The final toner product of 96.25 percent of the above polymer and 3.75 percent of the above pigment evidenced a particle size of 6.5 microns in volume average diameter with a particle size distribution of 1.21 as measured on a Coulter Counter, and was shown to be of a potato shape by scanning electron microscopy. The toner exhibited a tribo charge of −34.3 and −11.8 $\mu$C/gram at 20 and 80 percent relative humidity, respectively, when measured on a carrier with a core of a copper zinc ferrite, about 90 microns in diameter, with a coating of polymethylmethacrylate and carbon black, about 20 weight percent dispersed therein, following 2 washings with water.

ADSORPTION POLYMERIZATION ON CYAN TONER

2 Grams of trifluoroethylmethacrylate monomer in 100 grams of distilled water containing 0.1 gram poly (ethyleneglycol)-α-methyl ether-ω-methyl p-tert-octylphenyl phosphate were roll milled for 30 minutes to prepare solution A. Solution A was added slowly using a micropump at 1 millimeter/minute to a slurry of 60 grams of the above prepared cyan toner in 600 milliliters of distilled water at pH 12, measured using an Orion model 230A pH meter, and obtained by the addition of a 2 weight percent solution of potassium hydroxide. During the addition, the slurry was stirred at 380 rpm. Following monomer addition, the stirring speed was reduced to 180 rpm and the monomer allowed to adsorb for 45 minutes. 15 Milligrams of ammonium persulfate initiator dissolved in 50 milliliters distilled water were added slowly to the resulting toner slurry and the slurry heated to 40° C. for 4 hours. The resulting toner was then cooled to room temperature or 25° C., filtered and freeze dried. The final toner product was comprised of 96.25 percent of the styrene-butylacrylate acrylic acid polymer and 3.75 percent of cyan pigment with 1 weight percent polytrifluoroethyl methacrylate on the toner surface. The surface treated toner exhibited a tribo charge of −67 and −40 $\mu$C/gram at 20 and 80 percent relative humidity, respectively. This can be compared to the above non-surface treated cyan toner of −34.3 and −11.8 $\mu$C/gram at 20 and 80 percent relative humidity, respectively.

AGGREGATION OF YELLOW TONER 260.0 Grams of the latex emulsion as prepared above and 220.0 grams of an aqueous yellow pigment dispersion containing 32 grams of Yellow Pigment 17, and with a solids loading of 28.8 percent, and 2.4 grams of cationic surfactant SANIZOL B™ were simultaneously added to 400 milliliters of water with high shear stirring by means of a polytron at 6,000 rpm. The resulting mixture was transferred to a 2 liter reaction vessel and heated at a temperature of 50° C. for 2.0 hours resulting in aggregates of a size of 5.9 microns and a GSD of 1.22 before 30 milliliters of 20 percent aqueous NEOGEN R™ solution were added. Subsequently, the mixture was heated to 93° C. and held there for a period of 3 hours before cooling down to room temperature, filtered, washed with water, and dried in a freeze dryer. The final toner product of 92 percent polymer and 8 percent Pigment Yellow 17 evidenced a particle size of 6.3 microns in volume average diameter with a particle size distribution of 1.21 as measured on a Coulter Counter, and was shown to be smooth and spherical in shape by scanning electron microscopy. The toner exhibited a low tribo charge of −13 and −5 μC/gram at 20 and 80 percent relative humidity, respectively.

ADSORPTION POLYMERIZATION ON YELLOW TONER

2 Grams of trifluoroethylmethacrylate monomer in 100 grams of distilled water containing 0.1 gram of poly (ethyleneglycol)-α-methyl ether-ω-methyl p-tert-octylphenyl phosphate was roll milled for 30 minutes to prepare solution A. Solution A was added slowly using a micropump at 1 milliliter/minute to a slurry of 60 grams of the yellow toner described above in 600 milliliters of distilled water at pH 12 obtained by the addition of a 2 weight percent solution of potassium hydroxide and measured using an Orion model 230A pH meter. During the addition, the slurry was stirred at 380 rpm. Following monomer addition, the stirring speed was reduced to 180 rpm and the monomer allowed to adsorb for 45 minutes. 15 Milliliters of ammonium persulfate initiator dissolved in 50 milliliters of distilled water were added slowly to the toner slurry and the slurry heated to 40° C. for 4 hours to polymerize the monomer. The resulting toner was filtered and freeze dried. The final toner product consisted of 95 percent of the above styrene-butylacrylate acrylic acid polymer and 5 percent of the above yellow pigment with approximately 1 weight percent polytrifluoroethyl methacrylate on the toner surface.

The surface treated toner exhibited a tribo charge of −57 and −32 μC/gram at 20 and 80 percent relative humidity, respectively. This can be compared to the above non-surface treated yellow toner of −13 and −5 μC/gram at 20 and 80 percent relative humidity, respectively,

AGGREGATION OF MAGENTA TONER 260.0 Grams of the latex emulsion as prepared in Example I and 220.0 grams of an aqueous magenta pigment dispersion containing 32 grams of Magenta Pigment R81:3 having a solids loading of 21 percent, and 2.4 grams of cationic surfactant SANIZOL B™ were simultaneously added to 400 milliliters of water with high shear stirring by means of a polytron at 6,000 rpm. The resulting mixture was transferred to a 2 liter reaction vessel and heated at a temperature of 50° C. for 2.0 hours resulting in aggregates of a size of 5.9 microns and GSD of 1.20 before 30 milliliters of 20 percent aqueous NEOGEN R™ solution were added. Subsequently, the mixture was heated to 93° C. and held there for a period of 3 hours before cooling down to room temperature, filtered, washed with water, and dried in a freeze dryer.

The final toner product of 95 percent polymer and 5 percent Pigment Red 81:3 evidenced a particle size of 6.0 microns in volume average diameter with a particle size distribution of 1.20 as measured on a Coulter Counter, and was shown to be of potato shape by scanning electron microscopy. The toner exhibited a tribo charge of −10 and −4 μC/gram at 20 and 80 percent relative humidity, respectively.

Toner tribo was obtained by mixing in all instances the toner with carrier as indicated herein in Example I.

ADSORPTION POLYMERIZATION ON MAGENTA TONER 2 grams of trifluoroethylmethacrylate monomer in 100 grams distilled water containing 0.1 grams poly (ethyleneglycol)-α-methyl ether-ω-methyl p-tert-octylphenyl phosphate was roll milled for 30 minutes to prepare solution A. Solution A was added slowly using a micropump at 1 milliliters/minute to a slurry of 60 grams of the above toner in 600 milliliters of distilled water at pH 12 obtained by the addition of a 2 weight percent solution of potassium hydroxide and measured using an Orion model 230A pH meter. During the addition, the slurry was stirred at 380 rpm. Following monomer addition, the stirring speed was reduced to 180 rpm and the monomer allowed to adsorb for 45 minutes. 15 Milligrams of ammonium persulfate initiator dissolved in 50 milliliters of distilled water were added slowly to the toner slurry and the slurry heated to 40° C. for 4 hours. The resulting toner was then cooled to room temperature or 25° C. The resulting toner was filtered and freeze dried. The final toner product was comprised of 95 percent of the styrene-butylacrylate acrylic acid polymer and 5 percent of the above magenta pigment and approximately 1.2 weight percent polytrifluoroethyl methacrylate on the toner surface.

The surface treated toner exhibited a tribo charge of −52 and −28 μC/gram at 20 and 80 percent relative humidity, respectively. This can be compared to the above non-surface treated cyan toner of −10 and −4 μC/gram at 20 and 80 percent relative humidity, respectively.

AGGREGATION OF BLACK TONER 260.0 Grams of the latex emulsion as prepared in Example I and 220.0 grams of an aqueous black pigment dispersion containing 32 grams of carbon black REGAL 330® pigment having a solids loading of 21 percent, and 2.4 grams of cationic surfactant SANIZOL B™ were simultaneously added to 400 milliliters of water with high shear stirring by means of a polytron at 6,000 rpm. The resulting mixture was transferred to a 2 liter reaction vessel and heated at a temperature of 50° C. for 2.0 hours resulting in aggregates of a size of 6.2 microns and GSD of 1.22 before 30 milliliters of 20 percent aqueous NEOGEN R™ solution were added. Subsequently, the mixture was heated to 93° C. and held there for a period of 3 hours before cooling down to room temperature, filtered, washed with water, and dried in a freeze dryer. The final toner product of 95 percent polymer and 5 percent 330 carbon black pigment evidenced a particle size of 6.6 microns in volume average diameter with a particle size distribution of 1.22 as measured on a Coulter Counter, and was shown to be of potato shape by scanning electron microscopy. The toner exhibited a tribo charge of −11 and −4 μC/gram at 20 and 80 percent relative humidity, respectively.

ADSORPTION POLYMERIZATION ON BLACK TONER

2 Grams of trifluoroethylmethacrylate monomer in 100 grams distilled water containing 0.1 gram poly (ethyleneglycol)-α-methyl ether-ω-methyl p-tert-octylphenyl phosphate was roll milled for 30 minutes to prepare solution A. Solution A was added slowly using a micropump at 1 milliliter/minute to a slurry of 60 grams of the black toner described above in 600 milliliters of distilled water at pH 12 obtained by the addition of a 2 weight percent solution of potassium hydroxide and measured using an Orion model 230A pH meter. During the addition, the slurry was stirred at 380 rpm. Following monomer addition, the stirring speed was reduced to 180 rpm and the monomer allowed to adsorb for 45 minutes. 15 Milligrams of ammonium persulfate initiator dissolved in 50 milliliters of distilled water were added slowly to the toner slurry and the slurry heated to 40° C. for 4 hours. The resulting toner was then cooled to room temperature or 25° C. The resulting toner was filtered and freeze dried. The final toner product was comprised of 95 percent of the styrene-butylacrylate acrylic acid polymer and 5 percent of black pigment and approximately 1 weight percent polytrifluoroethyl methacrylate on the toner surface.

The surface treated toner exhibited a tribo charge of −60 and −34 $\mu$C/gram at 20 and 80 percent relative humidity, respectively. This can be compared to the above non-surface treated cyan toner of −11 and −4 $\mu$C/gram at 20 and 80 percent relative humidity, respectively.

Other embodiments and modifications of the present invention may occur to those skilled in the art subsequent to a review of the information presented herein; these embodiments and modifications, as well as equivalents thereof, are also included within the scope of the present invention.

What is claimed is:

1. A process for the preparation of toner comprising mixing a colorant dispersion and a resin latex emulsion, and wherein there is accomplished a heating below about or equal to about the resin glass transition temperature to form aggregates followed by heating above about or equal to about the resin glass transition temperature to coalesce the aggregates; separating the toner formed, and subsequently adding to the toner in the form of a slurry a mixture of monomer and surfactant, cleaving said surfactant under basic conditions, wherein the monomer is adsorbed on the toner, then polymerizing said monomer and optionally cooling, and wherein the surfactant is of the Formulas (I) or (II), or optionally mixtures thereof (I)

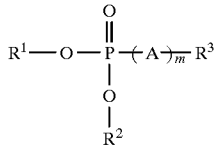

(II)

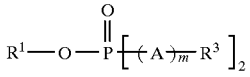

wherein $R^1$ is a hydrophobic aliphatic, or hydrophobic aromatic group; $R^2$ is selected from the group consisting of hydrogen, alkyl, aryl, alkylaryl, and alkylarylalkyl; $R^3$ is hydrogen or alkyl; A is a hydrophilic polymer chain, and m represents the number of A segments.

2. A process in accordance with claim 1 wherein the toner slurry is comprised of water and particles in the size range of from about 2 to about 10 microns, and wherein the toner is comprised of resin and colorant.

3. A process in accordance with claim 2 wherein the slurry contains from about 5 to about 40 weight percent of toner.

4. A process in accordance with claim 1 wherein said monomer is a fluorinated monomer.

5. A process in accordance with claim 1 wherein the said monomer is trifluoroethylmethacrylate (TFEMA), trifluoromethyl methacrylate, trifluoropropylmethacrylate, trifluoromethylacrylate, trifluoroethylacrylate, or fluoromethylmethacrylate.

6. A process in accordance with claim 1 wherein the monomer is present in the mixture in an amount of about 0.5 to about 10 weight percent, and the surfactant is present in an amount of about 0.01 to about 5 weight percent.

7. A process in accordance with claim 1 wherein the polymerizing of monomer is accomplished by heating at a temperature of about 75° C. to about 95° C.

8. A process in accordance with claim 1 wherein there is formed on the toner surface a polymer of poly (fluoromethylacrylate), poly(fluoroethylacrylate), poly (fluoropropylacrylate) poly(methylacrylate), poly (ethylacrylate), poly(propylacrylate), or poly (methylmethacrylate).

9. A process in accordance with claim 1 wherein the amount of monomer adsorbed is from about 0.5 to about 10 weight percent.

10. A process in accordance with claim 1 wherein the toner triboelectrical charge for the humidity range of about 20 to 80 percent is from about −10 to about −90 microcoulombs per gram.

11. A process in accordance with claim 1 wherein $R^1$ is alkyl, m is a number of from about 2 to about 60, and said A hydrophilic polymer is a poly(oxyalkyleneglycol) selected from the group consisting of a branched polyoxyalkyleneglycol, a block polyoxyalkyleneglycol and a homopolymeric polyoxyalkyleneglycol.

12. A process in accordance with claim 1 wherein m is a number of from about 5 to about 60, or from about 10 to about 50, and the weight average molecular weight of A is from about 100 to about 3,000.

13. A process in accordance with claim 1 wherein $R^1$ is methylphenyl, ethylphenyl, propylphenyl, butylphenyl, pentylphenyl, hexylphenyl, octylphenyl, or nonylphenyl; $R^2$ is hydrogen, methyl, ethyl, methylphenyl, or propyl; $R^3$ is methyl, ethyl, propyl, or butyl; and A is polyoxyalkyleneglycol, polyethyleneglycol, or polypropyleneglycol.

14. A process in accordance with claim 1 wherein $R^1$ is an alkylaryl group, or an alkylaryl group with a substituent of fluorine, chlorine, or bromine, wherein alkyl contains from about 2 to about 30 carbon atoms; $R^2$ alkyl contains from 1 to about 30 carbon atoms; $R^3$ alkyl contains from 1 to about 3 carbon atoms; and wherein A is a hydrophilic poly (oxyalkyleneglycol) selected from the group consisting of a branched, block or homopolymeric polyoxyalkyleneglycol derived from alkylene oxides with from about 2 to about 4 carbon atoms.

15. A process in accordance with claim 1 wherein the latex resin is generated from the polymerization of monomers to provide a latex emulsion with submicron resin particles in the size range of from about 0.05 to about 0.3 micron in volume average diameter, and wherein the latex contains an ionic surfactant, a water soluble initiator and a chain transfer agent; adding anionic surfactant to retain the size of the toner aggregates formed; thereafter coalescing or fusing said aggregates by heating; and optionally isolating, washing, and drying the toner.

16. A process in accordance with claim 1 wherein said surfactant is mixed with said toner slurry at a pH in the range of from about 8 to about 13.

17. A process in accordance with claim 16 wherein said basic condition is achieved by a medium, or solution in the pH range of from about 8.5 to about 12.

18. A process in accordance with claim 1 wherein said surfactant is selected in an amount of from about 1 to about 3 weight percent.

19. A process in accordance with claim 1 wherein there is selected a surfactant for the colorant dispersion, and which surfactant is a cationic surfactant, and an ionic surfactant is present in the latex mixture and which surfactant is an anionic surfactant; wherein the aggregation is accomplished at a temperature of about 15° C. to about 1° C. below the Tg of the latex resin for a duration of from about 0.5 hour to about 3 hours; and wherein the coalescence or fusion of the components of aggregates for the formation of integral toner particles comprised of colorant, and resin additives is accomplished at a temperature of from about 85° C. to about 95° C. for a duration of from about 1 hour to about 5 hours.

20. A process in accordance with claim 1 wherein the latex resin, or polymer is selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), and poly(alkyl acrylate-acrylonitrile-acrylic acid).

21. A process in accordance with claim 2 wherein the latex resin is selected from the group consisting of poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); and wherein said colorant is a pigment.

22. A process in accordance with claim 19 wherein the anionic surfactant is selected from the group consisting of sodium dodecyl sulfate, sodium dodecylbenzene sulfate and sodium dodecyinaphthalene sulfate.

23. A process in accordance with claim 1 wherein the colorant is carbon black, cyan, yellow, magenta, or mixtures thereof.

24. A process in accordance with claim 19 wherein the toner particles isolated are from about 2 to about 10 microns in volume average diameter, and the particle size distribution thereof is from about 1.15 to about 1.30, and wherein the ionic surfactant utilized represents from about 0.01 to about 5 weight percent of the total reaction mixture.

25. A process in accordance with claim 1 wherein there is added to the surface of the formed toner metal salts, metal salts of fatty acids, silicas, metal oxides, or mixtures thereof, each in an amount of from about 0.1 to about 10 weight percent of the obtained toner particles.

26. A process in accordance with claim 1 which comprises mixing a resin latex, an ionic surfactant and colorant, and a surfactant of the Formulas (I), or (II); heating the resulting mixture below about, or equal to about the glass transition temperature of the resin; thereafter heating the resulting aggregates above about, or about equal to the glass transition temperature of the resin; and cooling, isolating, washing and drying the toner (I)

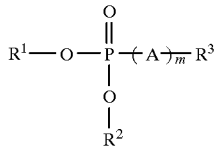

(II)

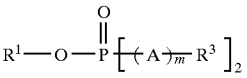

wherein $R^1$ is a hydrophobic group; $R^2$ is selected from the group consisting of hydrogen, alkyl, aryl, alkylaryl, and alkylarylalkyl; $R^3$ is hydrogen or alkyl; A is a hydrophilic segment; and m represents the number of A segments, and subsequently adding to the toner in the form of a slurry a mixture of monomer and cleavable surfactant and allowing the monomer to adsorb on the toner, then polymerizing and cooling.

27. A process in accordance with claim 1 wherein the surfactant is selected from the group consisting of poly (ethyleneglycol) methyl p-tert-octylphenyl phosphate, poly (ethyleneglycol)-α-methyl ether-ω-methyl p-tert-octylphenyl phosphate, poly(ethyleneglycol) methyl decylphenyl phosphate, poly(ethyleneglycol)-α-methyl ether-ω-methyl dodecylphenyl phosphate, poly (ethyleneglycol) methyl dodecylphenyl phosphate, bis[poly (ethyleneglycol)-α-methyl ether]-ω-p-tert-octylphenyl phosphate, poly(ethyleneglycol)-α,ω-methyl p-tert-octylphenyl phosphate, poly(ethyleneglycol) ethyl p-tert-octylphenyl phosphate, poly(ethyleneglycol)-α-methyl ether-ω-ethyl p-tert-octylphenyl phosphate, poly (ethyleneglycol) phenyl p-tert-octylphenyl phosphate, poly (ethyleneglycol)-α-methyl ether-ω-phenyl p-tert-octylphenyl phosphate, poly(ethyleneglycol) tolyl p-tert-octylphenyl phosphate, poly(ethyleneglycol)-α-methyl ether-ω-tolyl p-tert-octylphenyl phosphate, and poly (ethylene oxide-co-propylene oxide) methyl p-tert-octylphenyl phosphate, wherein the polymer chain contains from about 5 to about 50 repeating units or segments.

* * * * *